US005732888A

United States Patent [19]

Maier et al.

[11] Patent Number: 5,732,888

[45] Date of Patent: Mar. 31, 1998

[54] ELECTROMAGNETICALLY OPERABLE VALVE

[75] Inventors: Martin Maier, Möglingen; Norbert Keim, Bietigheim-Bissingen; Ferdinand Reiter; Jörg Heyse, both of Markgröningen, all of Germany

[73] Assignee: Robert Bosch GmbH, Stuttgart, Germany

[21] Appl. No.: 501,001

[22] PCT Filed: Nov. 24, 1994

[86] PCT No.: PCT/DE94/01392

§ 371 Date: Aug. 9, 1995

§ 102(e) Date: Aug. 9, 1995

[87] PCT Pub. No.: WO95/16126

PCT Pub. Date: Jun. 15, 1995

[30] Foreign Application Priority Data

Dec. 9, 1993 [DE] Germany ..... 43 41 961.5
Jun. 23, 1994 [DE] Germany ..... 44 21 935.0

[51] Int. Cl.[6] ..... F02M 51/00

[52] U.S. Cl. ..... 239/585.1; 251/129.15; 251/129.21

[58] Field of Search ..... 239/585.1, 585.2, 239/585.3, 585.4, 585.5; 251/129.01, 129.15, 129.21, 129.22

[56] References Cited

U.S. PATENT DOCUMENTS 4,527,744 7/1985 Hafner et al. .
4,875,658 10/1989 Asai ..... 239/585 X

FOREIGN PATENT DOCUMENTS 0 172 591 2/1986 European Pat. Off. .
0 536 773 4/1993 European Pat. Off. .
1 601 395 10/1970 Germany .
29 42 928 5/1981 Germany .
32 30 844 2/1984 Germany .
37 16 072 12/1986 Germany .
38 10 826 10/1989 Germany .

*Primary Examiner*—Andres Kashnikow
*Assistant Examiner*—Steven J. Ganey
*Attorney, Agent, or Firm*—Kenyon & Kenyon

[57] ABSTRACT

An electromagnetically operable valve includes at least one component part, e.g. the armature, which possesses, prior to the application of a wear resistant coating, a wedged surface, which is in each case variably creatable in accordance with a magnetic and hydraulic optimum. The annular impact segment formed by the wedging possesses a defined impact face width or contact width which remains constant throughout the service life, since any wearing of the impact face does not lead, in continuous running, to an enlargement of the contact. The valve is particularly suitable for use in fuel injection systems of explosion-type, spark-ignition combustion engines.

13 Claims, 4 Drawing Sheets

ELECTROMAGNETICALLY OPERABLE VALVE

FIELD OF THE INVENTION

The present invention relates to an electromagnetically operable valve.

BACKGROUND INFORMATION

A variety of electromagnetically operable valves, in particular fuel injection valves, are already known, in which wearing component parts are provided with wear resistant coatings.

From German Patent Application No. DE-A 29 42 928, it is already known to apply wear resistant diamagnetic material coatings to wearing parts such as armatures and nozzle bodies. These applied coatings serve to limit the lift of the valve needle, whereby the effects of the residual magnetism upon the moving parts of the fuel injection valve are minimized.

From German Patent application No. DE-A 32 30 844, it is likewise known to provide the armature and impact face of a fuel injection valve with wear resistant surfaces. These surfaces can be nickel-plated, for example, i.e. provided with an additional coating, or nitrided, i.e. hardened by impregnation with nitrogen.

In addition, it is already known from German Patent application No. DE-A 37 16 072, for parts of an injection valve which are particularly prone to wear and corrosion, to use molybdenum hard coatings which are thinly configured and can be subsequently worked with diamonds.

In German Patent application No. DE-A 38 10 826, a fuel injection valve is described in which at least one impact face is designed in the shape of a spherical cap in order to attain an extremely exact air gap, there being configured centrally on the impact face a round-body insert made from nonmagnetic, high-strength material.

From European Patent Application No. EP-A 0 536 773, a fuel injection valve is likewise known in which there is applied to the armature by galvanization, to its cylindrical peripheral surface and annular impact face, a hard-metal coating. This chromium or nickel coating possesses, for example, a thickness of 15 to 25 μm. As a result of the galvanic coating procedure, a slightly wedged coating thickness distribution is obtained, a minimally thicker coating being attained at the outer edges. As a result of the galvanically deposited coatings, the coating thickness distribution is physically predefined and barely influenceable. After a certain running time, the impact face widens undesirably as a result of wear, thereby giving rise to changes in the pull-in time and release time of the armature.

SUMMARY OF THE INVENTION

The electromagnetically operable valve according to the present invention, has the advantage relative to the above that at least one of the mutually impacting component parts is shaped such that, once a wear resistant surface has been generated, there is assurance that the impact face, even after a lengthy running time, will not be undesirably enlarged as a result of wear, so that the pull-in and release times of the movable component part remain virtually constant. This is achieved by the fact that at least one of the mutually impacting component parts, even before the wear resistance has been generated, possesses a wedged surface. This wedged surface can be accurately adapted in each case to different given circumstances in order to obtain a magnetic and hydraulic optimum.

It is particularly advantageous to create the extremely accurate surface shape, at least of one of the impacting component parts, by mechanical means using a ground counterbore. Very precise dimensions are thereby attainable. Using tools which have been very accurately ground, narrower production tolerances than previously achieved are able to be respected, so that, when the injection valve is running, a very small variance in the pull-in and, in particular, the release time of the armature is obtained.

It is additionally advantageous that, as a result of a wedged armature and/or core, hydraulic sticking is fully precluded, since, even where the coatings are by and large evenly deposited, the wedging remains in any event present. The coatings on at least one of the impacting component parts possess, namely, only a fraction of the wedging of the component parts themselves.

The wedged surface shape of the at least one component part, e.g. the armature, additionally enables the possible application of even nongalvanic and magnetic wear resistant coatings, without the requirement for a very small impact region remaining unsatisfied.

A particular advantage according to the present invention includes the fact that the surface, in its highest region lying nearest to the opposing component part, of at least one of the mutually impacting component parts is made wear resistant by virtue of being hardened by means of a process which is known per se, e.g. a nitriding process such as plasma-nitriding or gas-nitriding or similar.

DETAILED DESCRIPTION OF THE INVENTION

Figure 1:
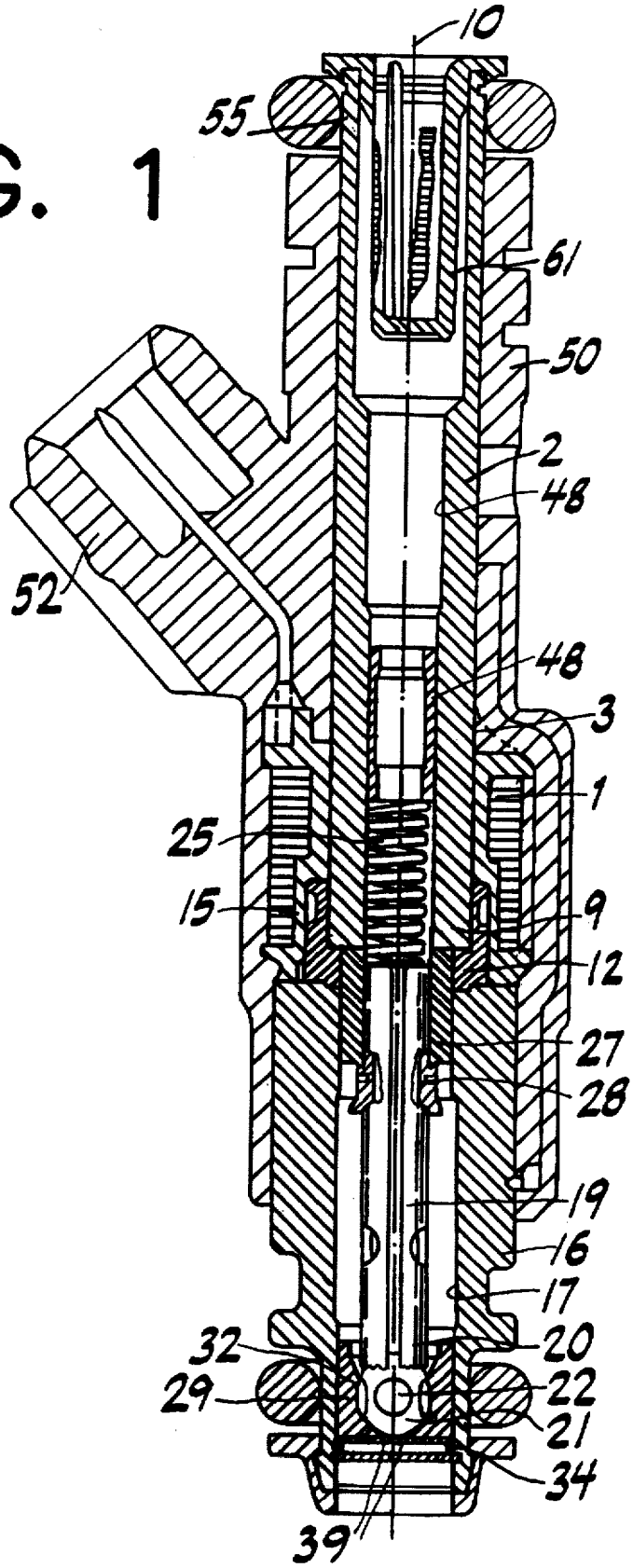
FIG. 1 shows a fuel injection valve according to the present invention.

The electromagnetically operable valve represented, by way of example, in FIG. 1, in the form of an injection valve for fuel injection systems of explosion-type, spark-ignition combustion engines, has a core 2, which is surrounded by a magnet coil 1 and serves as a fuel-intake socket and which is here, for example, of tubular configuration and exhibits a constant outer diameter throughout its length. A coil form 3, which is stepped in the radial direction, receives a winding of the magnet coil 1 and, in conjunction with the core 2 of constant external diameter, enables a particularly compact construction of the injection valve in the region of the magnet coil 1.

To a lower core end 9 of the core 2, concentric to a valve longitudinal axis 10, there is connected in seal-tight arrangement, for example by welding, a tubular metallic intermediate part 12 which partially surrounds the core end 9 in the axial direction. The stepped coil form 3 partially overlaps the core 2 and, with a step 15 of larger diameter, the intermediate part 12 at least partially in the axial direction. Downstream of the coil form 3 and intermediate part 12 there extends a tubular valve-seat carrier 16, which is connected, for example, fixedly to the intermediate part 12. In the valve-seat carrier 16 there runs a longitudinal bore 17, which is configured concentric to the valve longitudinal axis 10. In the longitudinal bore 17 there is disposed, for example, a tubular valve needle 19, which is connected at its downstream end 20, for example by welding, to a spherical valve-closing body 21, on the periphery of which there are provided, for example, five flattenings 22 to enable the fuel to flow past.

The actuation of the injection valve according to the present invention is realized in a known manner by electromagnetic means. The electromagnetic circuit containing the magnet coil 1, the core 2 and an armature 27 serves to move the valve needle 19 in the axial direction and hence to open, counter to the spring force of a restoring spring 25, or to close the injection valve. The armature 27 is connected by a first weld seam 28 to the end of the valve needle 19 facing away from the valve-closing body 21 and is aligned with the core 2. Into the end of the valve-seat carrier 16 which is situated downstream and faces away from the core 2 there is fitted in seal-tight arrangement, by welding, in the longitudinal bore 17, a cylindrical valve-seat body 29 exhibiting a fixed valve seat.

A guide opening 32 in the valve-seat body 29 serves to guide the valve-closing body 21 during the axial motion of the valve needle 19, with the armature 27, along the valve longitudinal axis 10. The spherical valve-closing body 21 interacts with the valve seat of the valve-seat body 29, which valve seat tapers frustoconically in the direction of flow. On its end side facing away from the valve-closing body 21, the valve-seat body 29 is connected concentrically and fixedly to a sprayhole disk 34 of, for example, pot-shaped configuration. Running in the bottom part of the sprayhole disk 34 there are at least one, for example four spray openings 39, which have been shaped out by erosion or punching.

The depth of insertion of the valve-seat body 29 with the pot-shaped sprayhole disk 34 determines the preset lift accorded to the valve needle 19. The one end setting of the valve needle 19, when the magnet coil 1 is not excited, is defined by the bearing contact of the valve-closing body 21 against the valve seat of the valve-seat body 29. The other end setting of the valve needle 19, when the magnet coil 1 is excited, is produced by the bearing contact of the armature 27 against the core end 9, i.e. in precisely that region which is configured according to the present invention and is more closely characterized by a circle.

An adjusting sleeve 48, which is inserted into a flow bore 46 of the core 2, said flow bore running concentrically to the valve longitudinal axis 10, and is formed, for example, out of rolled spring-steel plating, serves to adjust the spring bias of the restoring spring 25 bearing against the adjusting sleeve 48. The restoring spring is in turn supported, with its opposite side, against the valve needle 19.

The injection valve is largely enclosed by a plastic extrusion 50, which, originating from the core 2, extends in the axial direction over the magnet coil 1 and up to the valve-seat carrier 16. Forming part of this plastic extrusion 50 is, for example, an electric connecting plug 52, which has been jointly extruded.

A fuel filter 61 juts into the flow bore 46 of the core 2 at its intake-side end 55 and ensures that those fuel constituents which, because of their size, could cause blockages or damage in the injection valve, are filtered out.

Figure 2:
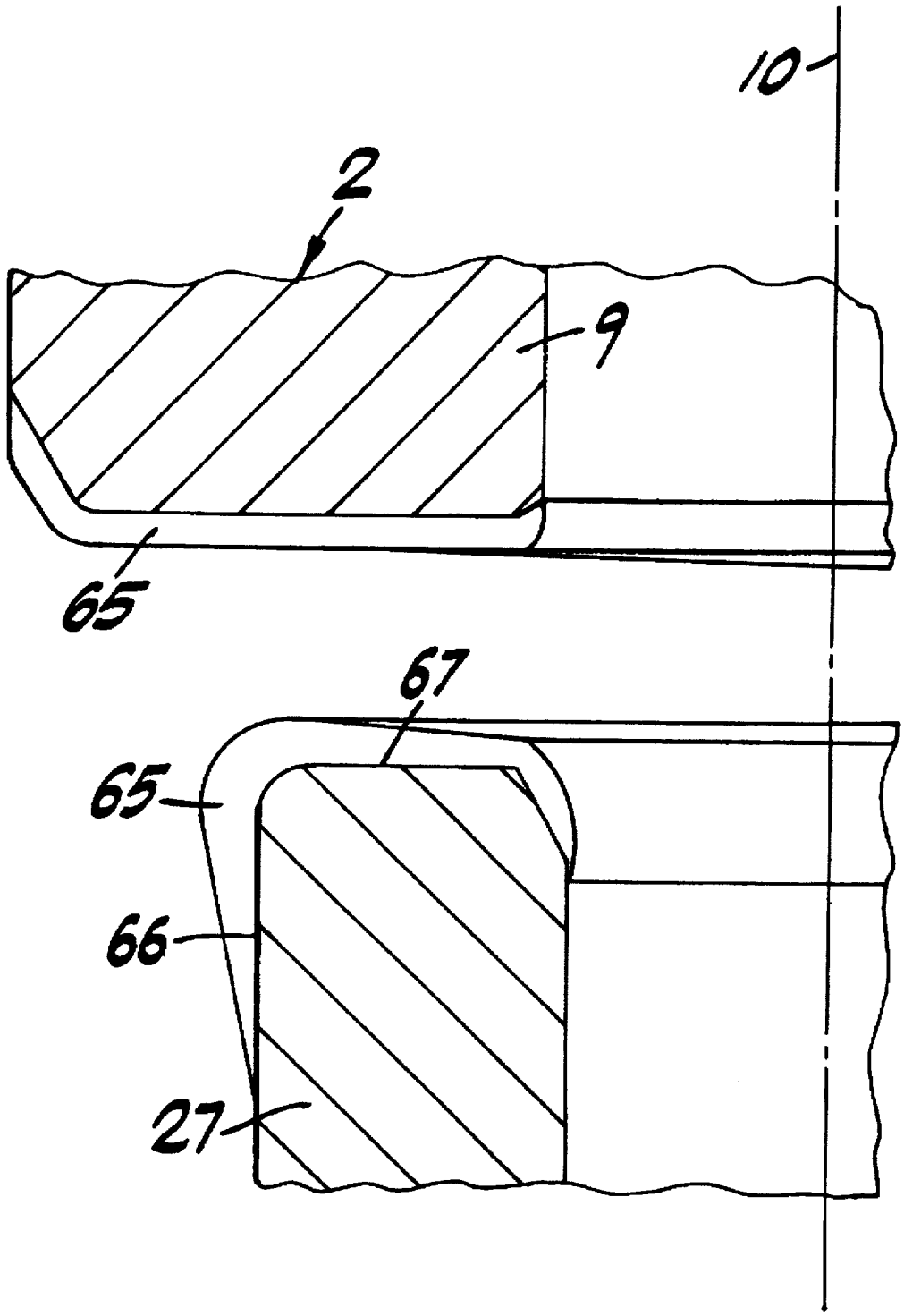
FIG. 2 shows an enlarged stop of the injection valve according to the present invention in the region of core and armature.

In FIG. 2, the region of the one end setting of the valve needle 19, which is characterized in FIG. 1 by a circle and in which the armature 27 impacts against the core end 9 of the core 2, is represented on a different scale. The application of metallic coatings 65, for example of chromium or nickel coatings, to the core end 9 of the core 2 and to the armature 27, by galvanization methods, is already known. The coatings 65 are in this case applied both to an end face 67 running perpendicular to the valve longitudinal axis 10 and at least partially to a peripheral surface 66 of the armature 27. These coatings 65 are particularly wear resistant and reduce, with their small surface, hydraulic sticking of the impacting faces, yet without being definitely able to prevent it. The coating thickness of these coatings 65 generally measures between 10 and 25 μm.

For the functioning of the injection valve according to the present invention, it is necessary that the core 2 and armature 27 should impact only in a relatively small region, for example only in that outer region of the upper end face of the armature 27 which faces away from the valve longitudinal axis 10. This requirement is specifically satisfied by the galvanic coating procedure. During the galvanic coating, there develops at the edges of the parts to be coated, in this case the core 2 and armature 27, a field line concentration, which results in the development of a wedged coating thickness distribution as indicated in FIG. 2. The applied wedged coating 65, when the injection valve is running, is only therefore, subjected to load in a small region. In continuous running, however, a defined impact face is no longer present, since parts of the coating 65 are worn away as a result of several million impacts, so that the impact face grows increasingly large and hence the wedging is constantly being further reduced.

Figure 3:
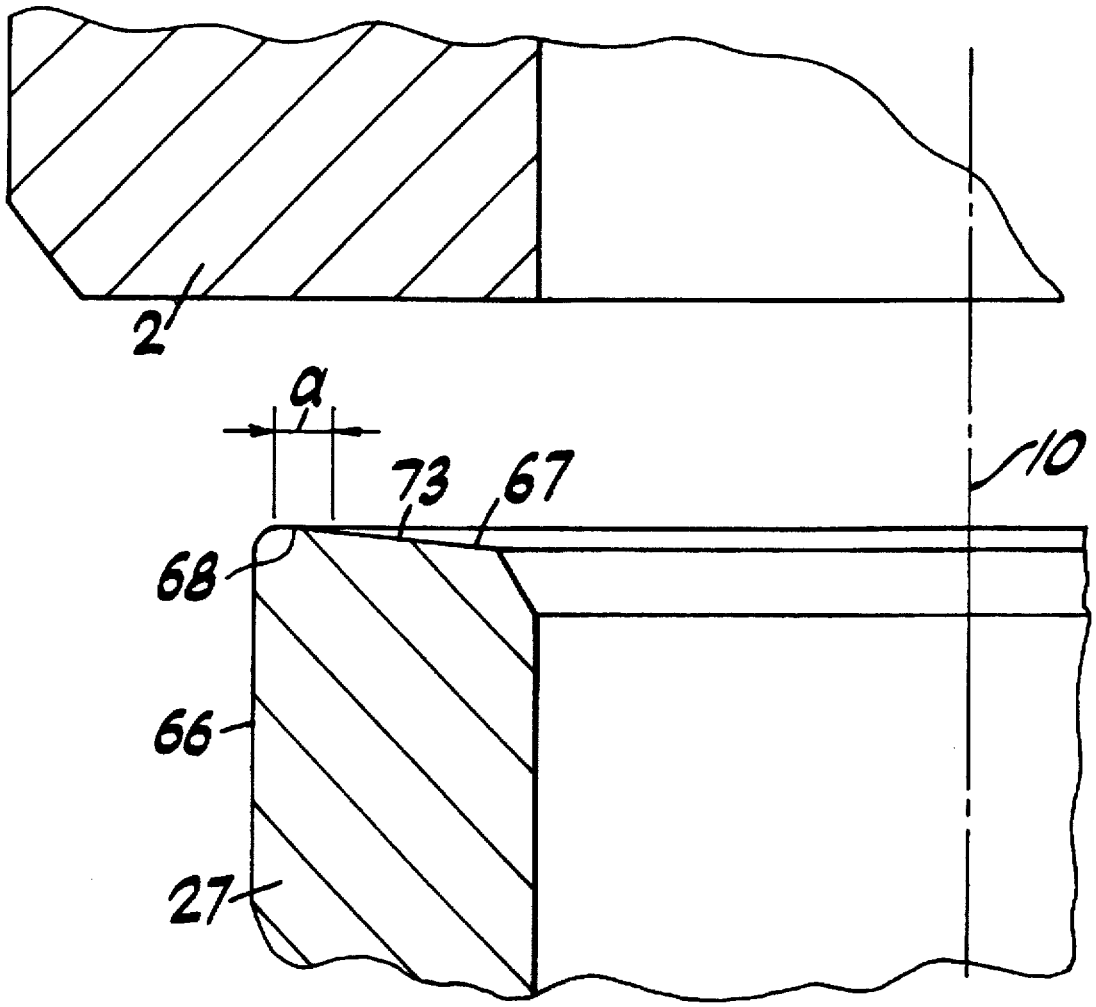
FIG. 3 shows a first illustrative embodiment of a wedged armature configured according to the present invention.
Figure 4:
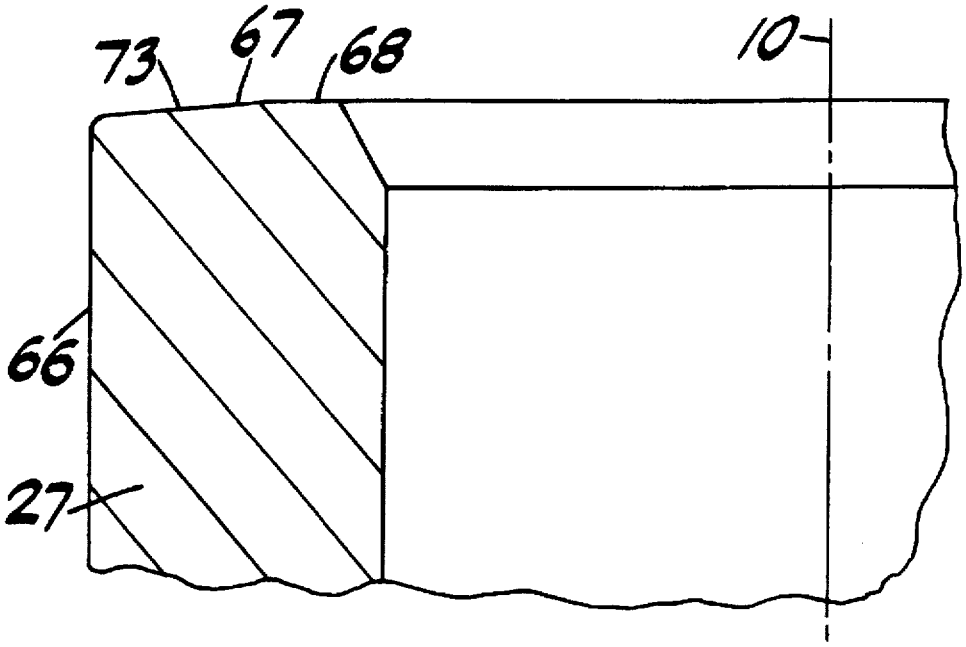
FIG. 4 shows a second illustrative embodiment of a wedged armature according to the present invention.

In contrast to the above, FIG. 3 depicts a part of the armature 27 according to the present invention in the region of its upper end face 67, which end face, even prior to the coating procedure or generation of the surface wear resistance, exhibits a wedge segment 73 having an inclined, oblique course relative to the valve longitudinal axis 10, so that the armature 27 there has a wedge shape. In the illustrative embodiment in FIG. 3, the inclination of the wedge segment 73 of the end face 67 of the armature 27 runs inwards, although a wedge segment 73 of the end face 67 can also be of outwardly inclined configuration (FIG. 4). The wedge shape of the armature 27 in the region of the end face 67 is already created in the mechanical working, for example by a suitably ground counterbore.

While the coating thickness distribution which is formed in the case of galvanically deposited coatings 65 is physically predefined and is barely influenceable, the wedging of the armature 27 can be predetermined and produced, prior to the coating procedure or generation of the wear resistance, in accordance with required values such that, during usage, a magnetic and hydraulic optimum is in each case achieved. Hydraulic sticking of the armature 27 to the core 2 is now fully precluded by the wedged armature, since, even where the coatings 65 (including magnetic coatings) are by and large evenly deposited, the wedging is in any event present. Using very accurately ground counterbores, production tolerances for the wedging which are narrower than previously achieved are able to be respected, so that, when the injection valve is running, a yet smaller variance in the pull-in and release times of the armature 27 is obtained. The inclined wedge segment 73 of the end face 67 additionally enables the possible application of even nongalvanic, wear resistant coatings, which may also be magnetic, without the requirement for a very small impact region remaining unsatisfied.

In addition, the end face 67, at least in the region of its highest point, can be made wear resistant by a surface treatment using a hardening process. As hardening processes, the known nitriding processes such as plasma-nitriding or gas-nitriding, for example, are suitable for this purpose.

In the illustrative embodiment according to the present invention shown in FIG. 3, there is first provided, originating from the peripheral face 66 of the armature 27, an impact segment 68 of the end face 67, which impact segment extends radially inwards, over a width a, perpendicular to the valve longitudinal axis 10 and serves as an impact face. This impact segment 68 constitutes, throughout the running period, an annular face which remains almost completely constant in its width a. The wearing of the impact face during continuous running is thus accurately defined. In order to achieve a hydraulic and magnetic optimum, the wedge segment 73 is ideally inclined by an angle greater than 0°and less than or equal to relative to the impact segment 68. The minimally wedged coating 65, formed, for example, from chromium, which is deposited on the end face 67, possesses only a fraction of the inclination of that inclined wedge segment 73 of the armature 27 which inwardly adjoins the impact segment 68. Consequently, that inclination of the wedge segment 73 which is provided prior to the coating of the armature 27 is fully maintained or is minimally increased.

Since the impact face width corresponding to the width a of the impact segment 68 remains constant even in the event of wear, a constant contact width during the impacting of the core 2 and armature 27 is present throughout the service life, whereby the hydraulic ratios in the gap between the core 2 and the armature 27 also remain constant, this representing a particular advantage. As already mentioned, at least the surface of the impact segment 68 can also be made wear resistant by a hardening process, thereby obviating the need for an additional coating 65 to be applied to the end face 67.

The same effects can similarly be obtained if both the armature 27 and the core 2 are provided, prior to the coating procedure or generation of a wear resistant surface, with wedge segments 73 of the end faces 67. A yet higher impacting reliability or prevention of hydraulic sticking is thereby able to be assured. Where it is expedient, the fitting of a wedge segment of the end face can, of course, also be performed only on the core 2, the armature 27 retaining, for example, a flat end face.

Figure 5:
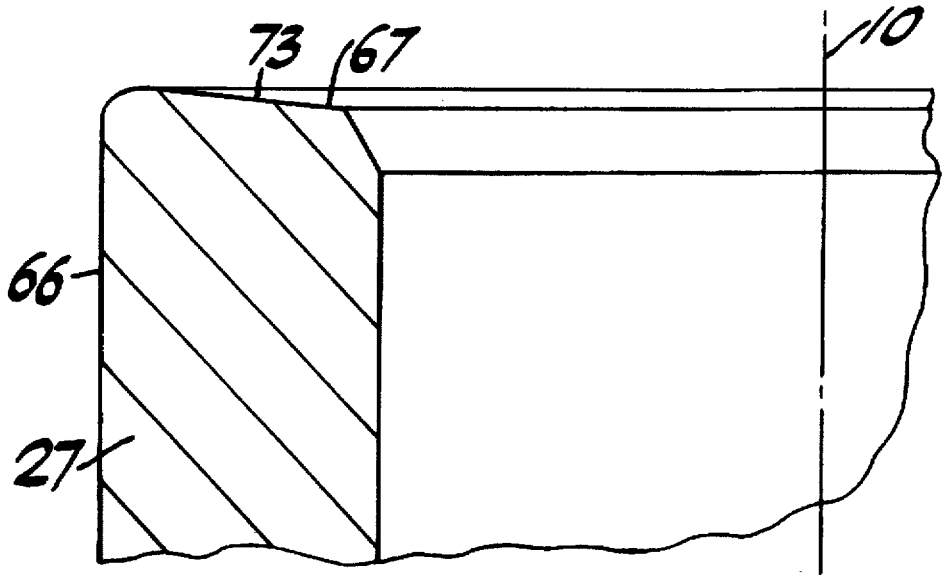
FIG. 5 shows a third illustrative embodiment of a wedged armature according to the present invention.

Further illustrative embodiments of armatures 27 configured according to the present invention are shown by FIGS. 4 and 5. FIG. 4 depicts an armature 27, in which the wedge segment 73 of the end face 67 is of outwardly inclined design.

An illustrative embodiment, according to the present invention, of the armature 27, in which the end face 67 is formed only by the wedge segment 73, is shown by FIG. 5. The impact segment 68 exhibiting the at least one small radial extent is in this case fully relinquished; rather, a wedging is present on the whole of the end face 67, i.e. there is no region of the end face 67 running perpendicular to the valve longitudinal axis 10. Particularly where the angles of the wedge segment 73 are very small, a stable impact face is present here too, so that, even during continuous running, a defined impact face remains. Besides the option in which the inclination of the wedge segment 73 runs in the direction of the valve longitudinal axis 10, which option is shown in FIG. 5, an illustrative embodiment analogous to the illustrative embodiment represented in FIG. 4 is also conceivable, in which the wedge segment 73 extends in the direction away from the valve longitudinal axis 10, i.e. is of outwardly inclined design.

Since, on at least one end face 67 of the armature 27 and/or core 2, the wedge segment 73 is already present, which has hitherto only been obtained by the application of chromium or nickel coatings, other processes for quality enhancement by improving the wear resistance of the end face 67 can now, as already mentioned, also be used. By the use of hardening processes such as, for example, plasma-nitriding, gas-nitriding or carbureting, by which the surface structure on the armature 27 and/or core 2 is altered, it is even possible to completely relinquish direct coating procedures.

What is claimed is:

1. An electromagnetically operable valve for a fuel injection system of an internal combustion engine, the valve having a longitudinal valve axis, comprising:

a ferromagnetic core having a first end face;

a magnetic coil at least partially surrounding the ferromagnetic core; and an armature coupled to the magnetic coil and being responsive to the magnetic coil, the armature having a second end face opposed to the first end face, the armature actuating a valve closing element, the valve closing element interacting with a fixed valve seat, the second end face being drawn against the first end face when the magnetic coil is excited, wherein, in an uncovered state, at least one of the first end face and the second end face is uncovered and includes at least one wedge segment running obliquely to the longitudinal valve axis.

2. The electromagnetically operable valve according to claim 1, wherein the at least one of the first end face and the second end face further includes at least one impact segment, the at least one impact segment having a predetermined width.

3. The electromagnetically operable valve according to claim 2, wherein the width of the at least one impact segment is smaller than a diameter of the second end face.

4. The electromagnetically operable valve according to claim 2, wherein the at least one wedge segment extends in a direction inclined towards the longitudinal valve axis.

5. The electromagnetically operable valve according to claim 2, wherein the at least one wedge segment extends in a direction inclined away from the longitudinal valve axis.

6. The electromagnetically operable valve according to claim 1, wherein at least one of the first end face and the second end face are coated.

7. The electromagnetically operable valve according to claim 6, wherein the coating includes a wear-resistant coating.

8. The electromagnetically operable valve according to claim 6, wherein the coating is applied via a magnetic coating procedure.

9. The electromagnetically operable valve according to claim 1, wherein at least one of the first end face and the second end face are treated with a hardening process.

10. The electromagnetically operable valve according to claim 1, wherein the at least one wedge segment extends over the entirety of one of the first end face and the second end face.

11. The electromagnetically operable valve according to claim 1, wherein the second end face includes the at least one wedge segment running obliquely to the longitudinal valve axis.

12. An electromagnetically operable valve having a longitudinal valve axis, comprising:

a ferromagnetic core having a first end face;

a magnetic coil at least partially surrounding the ferromagnetic core; and an armature coupled to the magnetic coil and being responsive to the magnetic coil, the armature having a second end face opposed to the first end face, the armature actuating a valve closing element, the second end face being drawn against the first end face when the magnetic coil is excited, wherein, in an uncovered state, at least one of the first end face and the second end face is uncovered and includes at least one wedge segment running obliquely to the longitudinal valve axis.

13. The electromagnetically operable valve according to claim 12, wherein the second end face includes the at least one wedge segment running obliquely to the longitudinal valve axis.

* * * * *

UNITED STATES PATENT AND TRADEMARK OFFICE

CERTIFICATE OF CORRECTION

PATENT NO. : 5,732,888
DATED : March 31, 1998
INVENTOR(S) : Martin Maier et al.

It is certified that error appears in the above-identified patent and that said Letters Patent is hereby corrected as shown below:

Abstract, line 10, after "contact" insert -- width --;

Column 1, lines 20,27 and 31"application" should be --Application--.

Column 5, line 16, before "relative" insert -- 1°,--.

Signed and Sealed this

Tenth Day of November 1998

Bruce Lehman

*Attest:*

BRUCE LEHMAN

*Attesting Officer*

*Commissioner of Patents and Trademarks*